US006447153B1

(12) United States Patent
Kawamura

(10) Patent No.: US 6,447,153 B1
(45) Date of Patent: Sep. 10, 2002

(54) HEADLAMP FOR VEHICLE

(75) Inventor: Takayuki Kawamura, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 47 days.

(21) Appl. No.: 09/639,174

(22) Filed: Aug. 16, 2000

(30) Foreign Application Priority Data

Aug. 18, 1999 (JP) ..... 11-231604

(51) Int. Cl.[7] ..... F21V 17/02

(52) U.S. Cl. ..... 362/507; 362/512; 362/513; 362/514; 362/283; 362/509; 362/517; 362/322; 362/323; 362/324

(58) Field of Search ..... 362/512–514, 362/283, 284, 322, 323, 324, 509, 517, 523

(56) References Cited

U.S. PATENT DOCUMENTS 5,584,560 A * 12/1996 Gosswiller et al. ..... 362/66
6,059,435 A * 5/2000 Hamm et al. ..... 362/514
6,161,950 A * 12/2000 Tsukamoto et al. ..... 362/513
6,354,722 B1 * 3/2002 Montenegro et al. ..... 362/514

FOREIGN PATENT DOCUMENTS

JP 05286392 * 11/1993 ..... 362/507

* cited by examiner

*Primary Examiner*—Sandra O'Shea
*Assistant Examiner*—Anabel Ton
(74) *Attorney, Agent, or Firm*—Foley & Lardner

(57) ABSTRACT

A reflector is for reflecting light rays from the light source bulb to set up a brightness intensity distribution pattern. The reflector is separated in a movable reflector part and a fixed reflector part. The movable reflector part has a first separated edge. The fixed part has a second separated edge in opposition to the first separated edge. A driving means is for moving the movable reflector part relative to the fixed reflector part to change a brightness intensity distribution pattern of light rays from the light source bulb. The shading flange is for shading an air gap between the first separated edge and the second separated edge.

20 Claims, 4 Drawing Sheets

HEADLAMP FOR VEHICLE

BACKGROUND OF THE INVENTION

1. Field of the Invention

The present invention relates to a headlamp for a vehicle where a movable reflector is moved to change a brightness intensity distribution pattern, and in particular to a headlamp for a vehicle where, even when a movable reflector is moved, an air gap does not occur between the movable reflector and another reflector.

2. Description of Relevant Art

As the headlamp for an automobile, there is one which has been disclosed, for example, in Japanese Patent Application Laid-Open (JP-A) No. 5-286392 publication. It should be noted that the headlamp described in this publication has a structure where a main reflector and a sub-reflector having two separated members are moved together.

SUMMARY OF THE INVENTION

However, in the above-mentioned conventional headlamp for an automobile, since the reflector is merely separated into the fixed reflector and the movable reflector, when the movable reflector is moved or rotated relative to the fixed reflector, there occurs an air gap between a separation edge of the fixed reflector and a separation edge of the movable reflector.

That is, air gaps are respectively generated in an opening manner between an outer face (a face opposed to the reflecting face) side of the separation edge of the fixed reflector and an inner face (the reflecting face) side of the separation edge of the movable reflector, and between an inner face (the reflecting face) side of the separation edge of the fixed reflector and an outer face (a face opposed to the reflecting face) side of the separation edge of the movable reflector.

When the gap is generated, there occurs a drawback regarding appearance of the lamp because such an interior member as a wire, a screw or the like positioned on back sides of the fixed reflector and the movable reflector is seen from the front of the lamp. Also, light from the light source bulb leaks into the back sides of the fixed reflector and the movable reflector. Then, when the light source bulb is a discharge lamp like this example, there is such a drawback that parts of the headlamp may deteriorate due to ultraviolet light of the discharge lamp.

An object of the present invention is to provide a headlamp for a vehicle which improves drawback caused by an air gap between a movable reflector and another reflector.

In order to achieve the above object, a first aspect of the present invention provides a headlamp for a vehicle. The headlamp has a first reflector; and a second reflector for cooperating with the first reflector to set up a brightness intensity distribution pattern. The second reflector and the first reflector define an air gap therebetween. The second reflector is flanged for shading the air gap.

Preferably, the first reflector is flanged for shading the air gap.

Preferably, a flanged part of the second reflector is positioned at an edge of the second reflector.

Preferably, the first reflector is to be moved relative to the second reflector.

Preferably, the second reflector is to be moved relative to the first reflector.

A second aspect of the invention provides a headlamp for a vehicle. The headlamp has a light source bulb. The headlamp has a reflector for reflecting light rays from the light source bulb to set up a brightness intensity distribution pattern. The reflector is separated in a movable reflector part and a fixed reflector part. The movable reflector part has a first separated edge. The fixed reflector part has a second separated edge in opposition to the first separated edge. The headlamp has a driving means for moving the movable reflector part relative to the fixed reflector part to change a brightness intensity distribution pattern of light rays from the light source bulb. The headlamp has a shading flange for shading an air gap between the first separated edge and the second separated edge.

Preferably, the shading flange is wider than a movement range of the movable reflector part.

Preferably, the shading flange projects from the first separated edge.

Preferably, the shading flange always overlaps with the second separated edge.

Preferably, the shading flange projects from the second separated edge.

Preferably, the shading flange always overlaps with the first separated edge.

Preferably, a pair of shading flanges project from the first separated edge and the second separated edge.

Preferably, the first separated edge and the second separated edge are positioned above an optical axis of the light source bulb.

Preferably, the light source bulb is a discharge lamp.

A third aspect of the invention provides a headlamp for a vehicle. The headlamp has a light source bulb. The headlamp has a reflector for reflecting light rays from the light source bulb to set up a brightness intensity distribution pattern. The reflector is separated in a plurality of reflector parts. The headlamp has a driving means for moving at least one movable reflector part of reflector parts to change a brightness intensity distribution pattern of light rays from the light source bulb. The headlamp has a shading flange projecting from at least one of separated edges of a movable reflector part and another reflector part, the shading flange being wider than a movement range of the movable reflector, the shading flange and a separated edge always overlap with each other.

As a result, in a headlamp for a vehicle of the present invention, a shading flange wider than a movement range of a movable reflector part always overlaps the first separated edge of the movable reflector part or a second separated edge of the fixed reflector part. Accordingly, even when the movable reflector part is moved, the shading flange shades an air gap between the movable reflector, part and the fixed reflector part, so that a reflected light does not project from the air gap, for example. Thus, the drawback due to the gap occurrence can be solved.

BRIEF DESCRIPTION OF THE ACCOMPANYING DRAWINGS

These and other features, aspects, and advantage of the present invention will become better under stood with regard to the following description, appended claims, and accompanying drawings where:

DETAILED DESCRIPTION OF THE PREFERRED EMBODIMENTS

An embodiment of a headlamp for an automobile of the present invention will be explained below with reference to FIG. 1 to FIG. 5.

A light source bulb 1 is, for example, a discharge lamp (a high pressure metal vapor discharge lamp such as a metal halide lamp or the like, high intensity discharge lamp (HID) or the like), and it is detachably attached to a fixed reflector 2 described later through a socket 10. Incidentally, as the light source bulb, another bulb other than this example, for example, a tungsten halogen lamp, an incandescent lamp or the like may be used.

Figure 1:
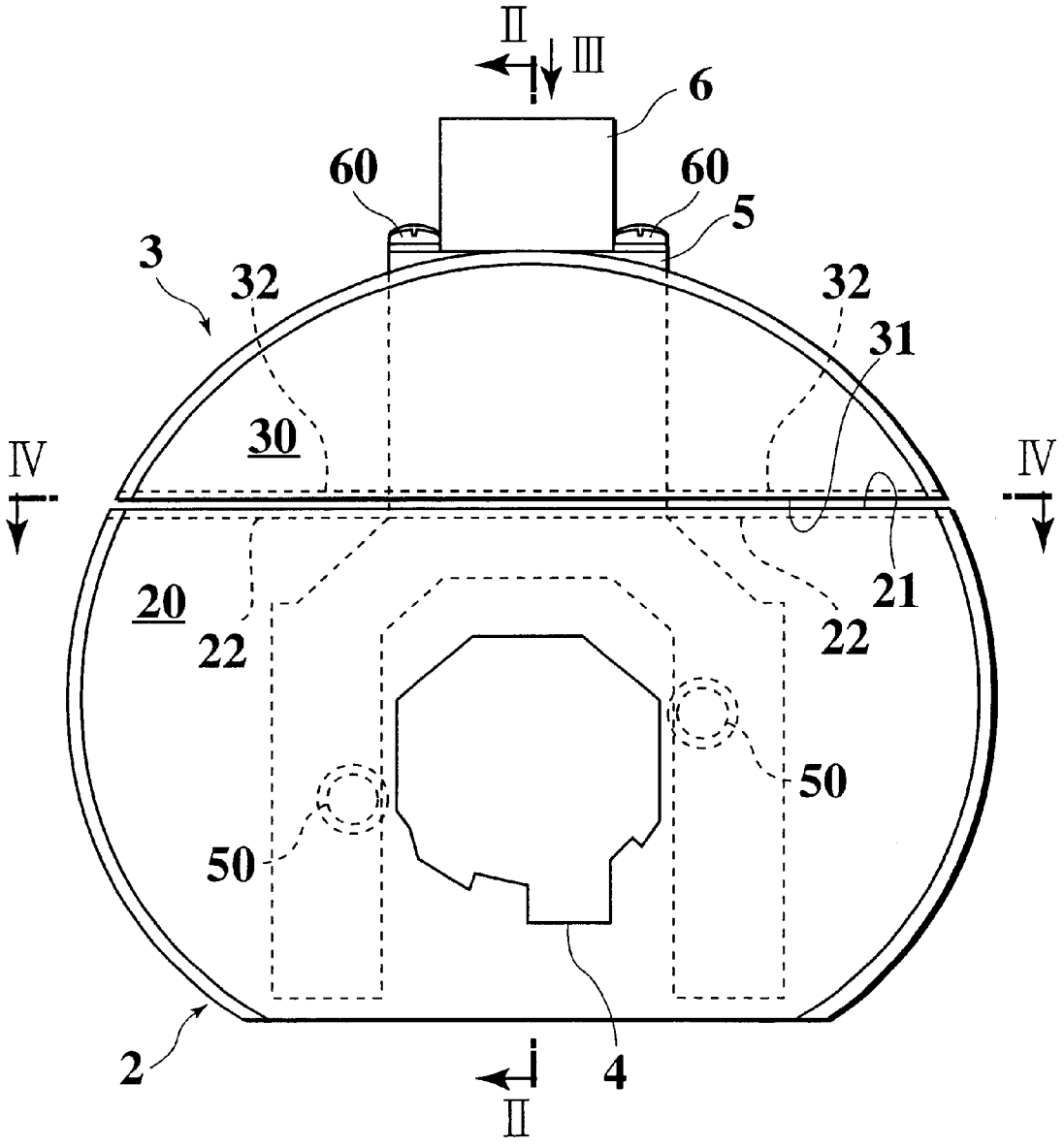
FIG. 1 is a front view of a main portion of a headlamp for an automobile according to an embodiment of the present invention.
Figure 2:
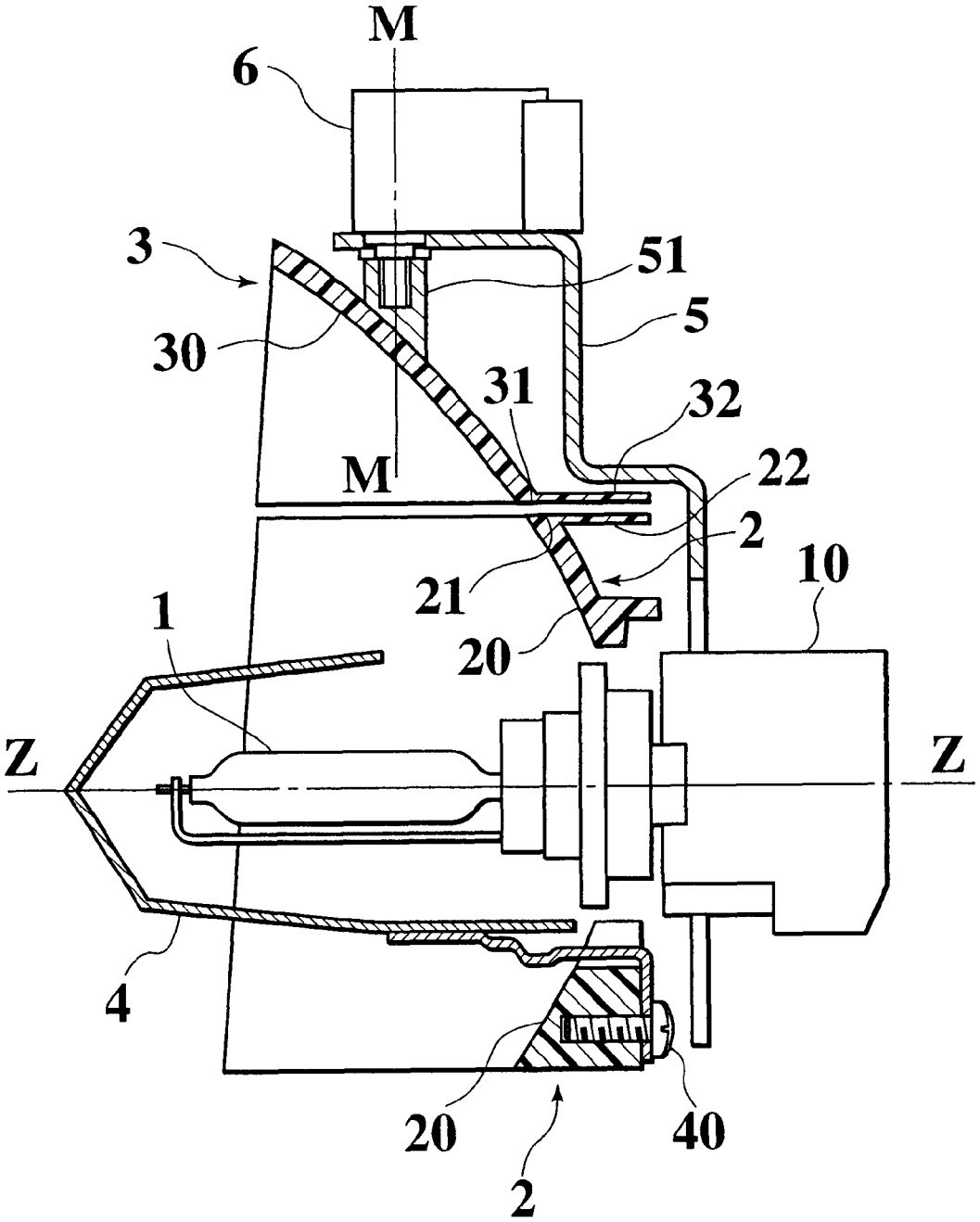
FIG. 2 is a sectional view taken along line II—II in FIG.
Figure 3:
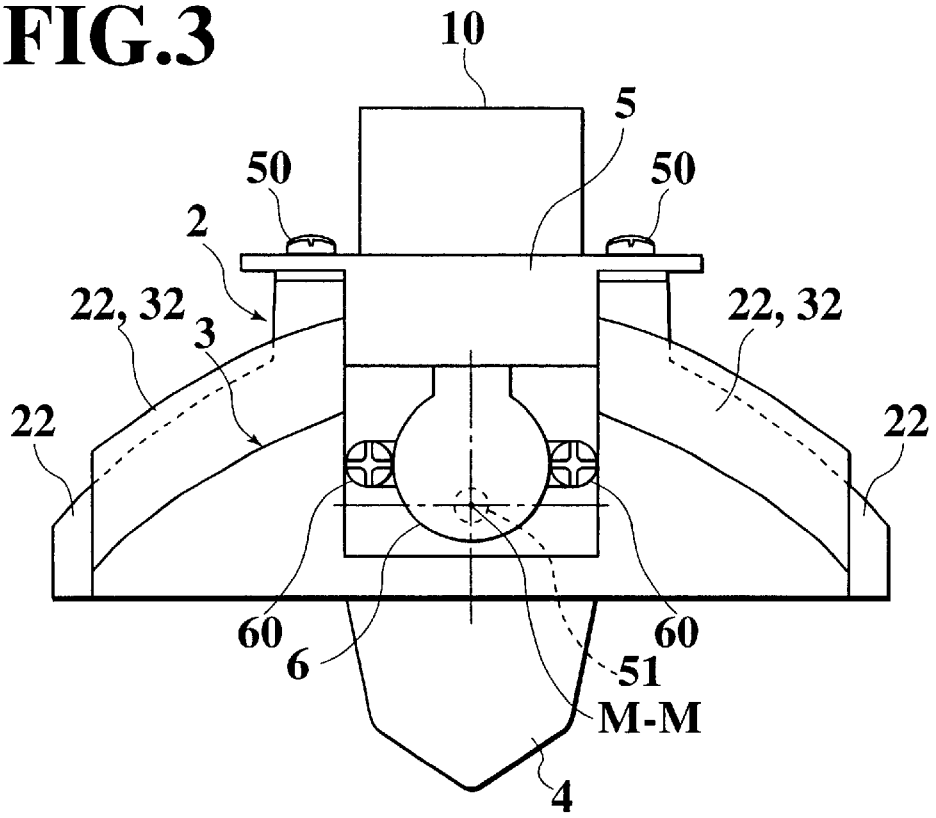
FIG. 3 is a view seen along arrow III in FIG. 1.

As shown in FIG. 1, the fixed reflector 2 and a movable reflector 3 are structured by separating a reflector, which has a generally circular shape (a lower portion is formed in a flat shape) as viewed from the front, in upper and lower members at its upper portion along a horizontal separation line. Reflecting faces 20 and 30 are respectively provided on inside faces of the fixed reflector 2 and the movable reflector 3.

The fixed reflector 2 is fixed to a lamp housing (not shown). The light source bulb 1 is detachably attached to the fixed reflector 2. A shade 4 and a bracket 5 are respectively fixed to the fixed reflector 2 by screws 40, 50.

On the other hand, the movable reflector 3 is mounted to the bracket 5 through a holder 51 rotatably (movably) about an axis M—M which is substantially at a right angle to an optical axis Z—Z.

Driving means 6 is mounted to the bracket 5 by screws 60. The driving means 6 rotates the movable reflector 3 relative to the fixed reflector 2 and the bracket 5 about the axis M—M, for example, in an interlocking manner with the steering wheel (not shown) of an automobile (not shown).

Figure 5:
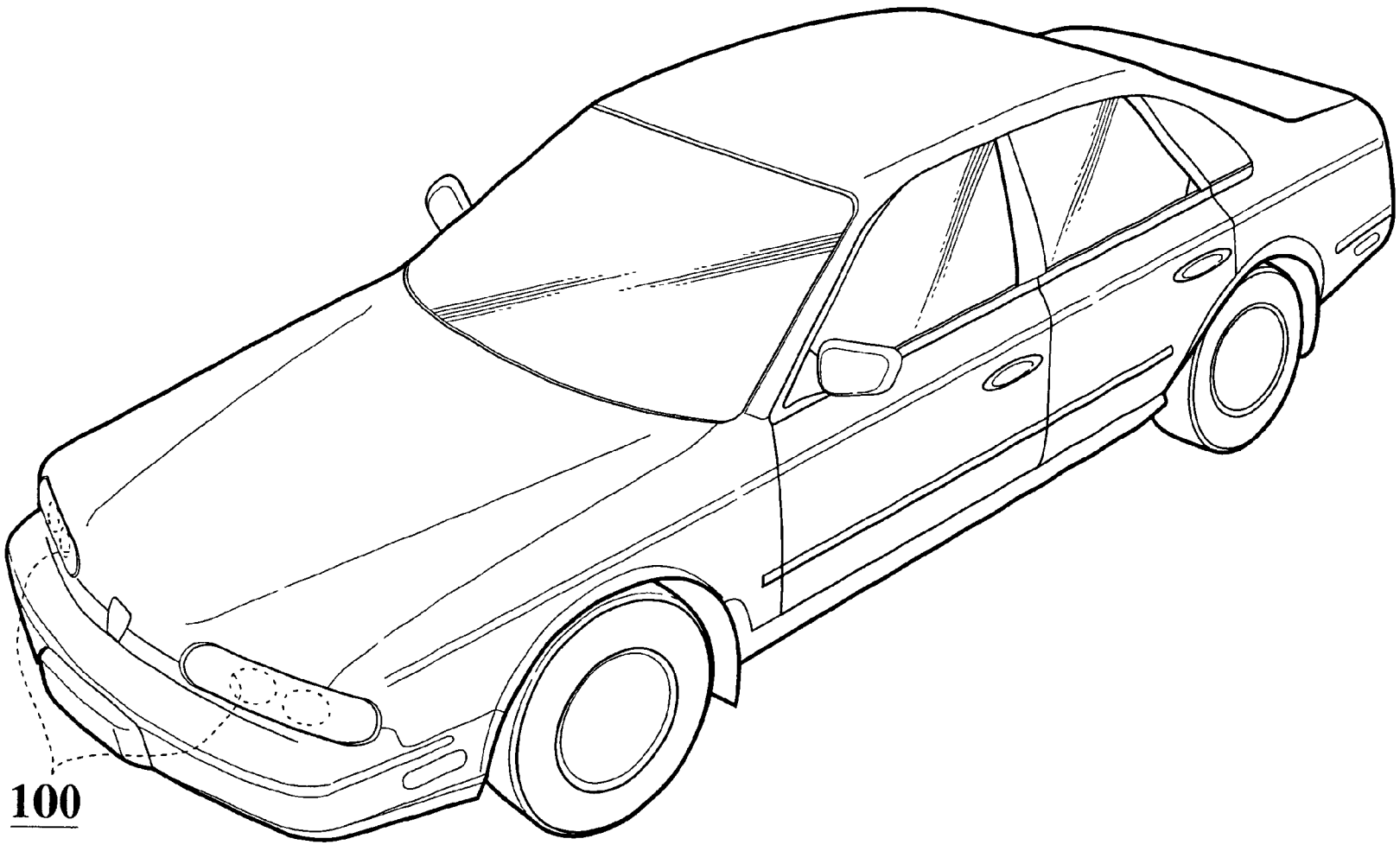
FIG. 5 is a perspective view of an automobile for which a headlamp of an embodiment is adapted.

The light source bulb 1, the fixed reflector 2, the movable reflector 3, the shade 4, the bracket 5, the holder 50 and the driving means 6 are disposed inside a light chamber (not shown) defined by the lamp housing and a front lens or a front cover (not shown), thereby structuring a headlamp for an automobile. The headlamp 100 for an automobile thus structured is, as shown in FIG. 5, equipped on each of left and right sides of a front portion of the automobile.

Shading flanges 22, 32 are provided at outer face side of separation edges 21 and 31 of a fixed reflector 2 and a movable reflector 3 integrally therewith. Each of the shading flanges 22, 32 is formed in a shape of a portion of an annular shape (so-called railway rule) and it has an area and shape wider than a movement range of the movable reflector 3. Then, the separation edges 21, 31 and the shading flanges 22, 32 are always overlapped with each other. The shading flanges 22, 33 may are provided at a part of the outer face side of separation edges 21, 31.

Working of the headlamp is explained.

When the light source bulb 1 is turned on, light from the light source bulb 1 is reflected by the fixed reflector 2 and a reflecting face 20 and 30 of the movable reflector 3 to be projected outside with a predetermined brightness intensity distribution pattern. The predetermined brightness intensity distribution pattern is controlled by a set of only the reflecting faces 20 and 30, a set of the reflecting faces 20, 30 and the front lens, or only the front lens.

Then, in a state where the light source bulb 1 is on, for example, when the steering wheel is turned left or right, the driving means 6 is actuated and the movable reflector 3 is rotated left or right about the axis M—M, so that a portion (a portion of the brightness intensity distribution pattern corresponding to the reflecting face 30 of the movable reflector 3) of the brightness intensity distribution pattern is swung left or right and the brightness intensity distribution pattern is changed.

At this time, there occurs an air gap between a separation edge 21 of the fixed reflector 2 and a separation edge 31 of the movable reflector 3.

Figure 4:
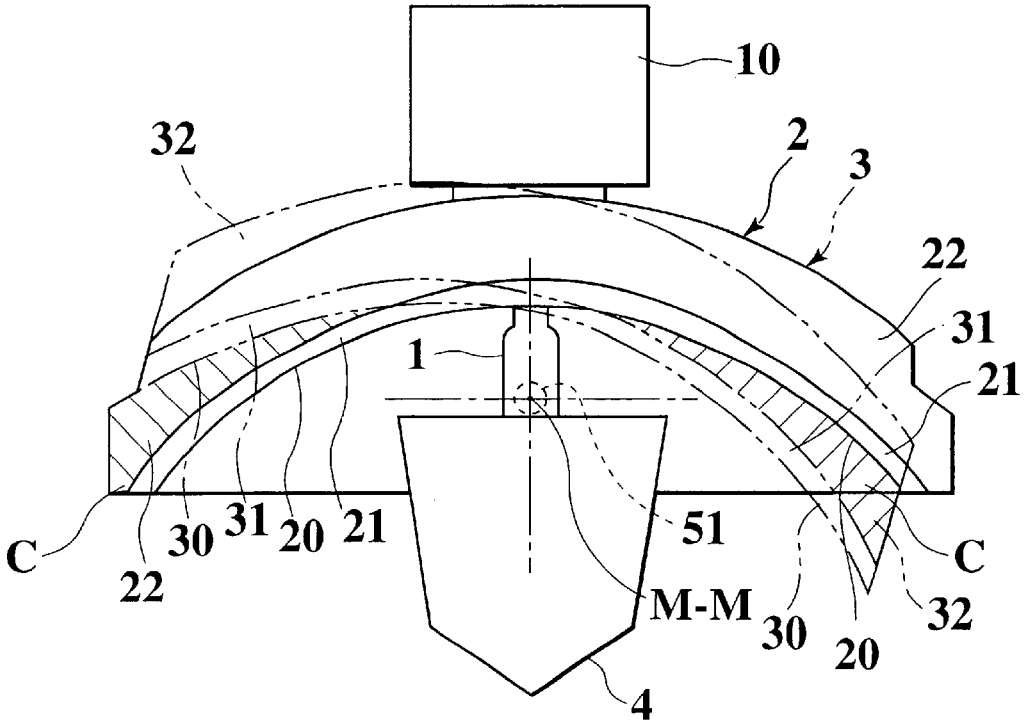
FIG. 4 is a sectional view taken along line IV—IV in FIG. 1 for explaining a state where a gap does not occur between a movable reflector and a fixed reflector even when the movable reflector is rotated.

As shown in FIG.4, air gaps are portions "C" (diagonal line portions in FIG. 4) between the separation edge 21 of the fixed reflector 2 (shown with a solid line in FIG. 4) and the separation edge 31 of the movable reflector 3 (shown with a double dotted bold line in FIG. 4). The portions "C" are shaded by the shading flanges 22 and 32. That is, on the left side in FIG. 4, the portion "C" between the outer face (the face opposed to the reflecting face 20) of the separation edge 21 of the fixed reflector 2 and an inner face (the reflecting face 30) of the separation edge 31 of the movable reflector 3 is overlapped with the shading flange 22 of the fixed reflector 2 to be shaded. Further, on the right side in FIG. 4, the portion "C" between the inner face (the reflecting face 20) of the separation edge 21 of the fixed reflector 2 and the outer face (the face opposed to the reflecting face 30) of the separation edge 31 of the movable reflector 3 is overlapped with the shading flange 32 of the movable reflector 3 to be shaded.

In this manner, in the headlamp for an automobile of the present invention in this embodiment, since the shading flanges 22 and 31 which are wider than the movement range of the movable reflector 3 are respectively provided at the separation edges 21 and 31 of the fixed reflector 2 and the movable reflector 3, the separation edges 21, 31 of the fixed reflector 2 and the movable reflector 3 and the shading flanges 22, 32 are always overlapped with each other. As a result, even when the movable reflector 3 is moved, since the portions "C" between the movable reflector 3 and another reflector, particularly, the fixed reflector 2 in this embodiment, are shaded by the shading flanges 22, 32, no gap occurs at the portions "C" between the reflectors so that the drawback due to occurrence of the gap can be solved. That is, such an interior member as a wire, a screw or the like positioned on the back sides of the fixed reflector 2 and the movable reflector 3 can not seen from the front of the headlamp so that appearance of the headlamp is improved. Also, light from the light source bulb 1 is prevented from leaking into the backsides of the fixed reflector 2 and the movable reflector 3. Then, even when the light source bulb 1 is a discharge lamp such as this embodiment, parts of the headlamp are prevented from deteriorating due to ultraviolet rays of the discharge lamp.

Especially, in this embodiment, since the shading flanges 22, 23 are provided at both of the separation edges 21, 31 of the fixed reflector 2 and the movable reflector 3, even when the movable reflector 3 is moved left or right relative to the fixed reflector 2 in a swinging manner, the gap or portion "C" between the separation edges 21, 31 of the fixed reflector 2 and the movable reflector 3 is securely shaded by the shading flanges 22, 32 of both the fixed reflector 2 and the movable reflector 3, so that occurrence of the gap can securely be prevented.

Also, in this embodiment, since the horizontal separation lines of the fixed reflector 2 and the movable reflector 3, namely the separation edges 21, 31 are positioned above the optical axis Z—Z, even when light from the light source bulb 1 is incident on the horizontal separation lines, particularly the shading flange 32 of the separation edge 31 of the movable reflector 3 positioned on the upper side, the light is reflected downward so that glare light can be prevented from occurring.

Furthermore, in this embodiment, since the shading flange 22 is provided at the separation edge 21 of the fixed reflector 2 positioned on the lower side, when the headlamp for an automobile of the present invention is viewed from the front thereof (in this case, since the height of human eyes is higher than that of the headlamp for an automobile, a person looks down obliquely at the headlamp), his/her eyes coming obliquely from above are shaded by the shading flange 22 of the fixed reflector 2. Accordingly, for example, even if the shading flange 32 is not provided at the separation edge 31 of the movable reflector 3 positioned above the fixed reflector, and a gap occurs between the shading flange 22 of the fixed reflector 2 and the separation edge 31 of the movable reflector 3, the interior member positioned on the back sides of the reflectors 2, 3 can not be seen.

Incidentally, in the above-mentioned embodiment, one of the reflectors which have been separated in two members is employed as the fixed reflector 2 while the other is employed as the movable reflector 3. However, both the reflectors may be employed as movable reflectors as disclosed in the above-mentioned publication.

Also, in the above-mentioned embodiment, the reflector is separated into two reflector members, but it may be separated into three or more reflector members.

Furthermore, in the above-mentioned embodiment, the shading flanges 22, 32 are provided at both the separation edges 21, 31 of the fixed reflector 2 and the movable reflector 3. However, the shading flange 22 or 32 may be provided at either one of the separation edge 21 of the fixed reflector 2 and the separation edge 31 of the movable reflector 3.

While preferred embodiments of the present invention have been described using specific terms, such description is for illustrative purposes, and it is to be understood that changes and variations may be made without departing from the spirit or scope of the following claims.

What is claimed is:

1. A headlamp for a vehicle comprising:

a light source configured to emit light; and a reflector separated into a first reflective part and a second reflective part for reflecting light from the light source to set up a brightness intensity distribution pattern, at least one of the first reflective part and the second-reflective part being movable relative to each other to change a brightness intensity distribution pattern and to define an air gap therebetween, at least one of the first reflective part and the second reflective part being flanged more widely than a movement range between the first reflective part and the second reflective part for shading light to transmit through the air gap.

2. A headlamp according to claim 1, wherein the first reflective part includes a first flanged edge facing the second reflective part.

3. A headlamp according to claim 1, wherein the second reflective part includes a second flanged edge facing the first reflective part.

4. A headlamp according to claim 1, wherein the first reflective part is movable relative to the second reflective part.

5. A headlamp according to claim 1, wherein the second reflective part is movable relative to the first reflective part.

6. A headlamp for a vehicle comprising:

a light source;

a reflector for reflecting light emitted from the light source to set up a brightness intensity distribution pattern, the reflector being separated into a movable reflector part and a fixed reflector part, the movable reflector part having a first separated edge, the fixed reflector part having a second separated edge facing the first separated edge;

an actuator for moving the movable reflector part relative to the fixed reflector part to change a brightness intensity distribution pattern of light from the light source; and a shading flange for shading light to transmit through an air gap between the first separated edge and the second separated edge, the shading flange being wider than a movement range of the movable reflector part.

7. A headlamp according to claim 6, wherein the shading flange projects from the first separated edge.

8. A headlamp according to claim 7, wherein the shading flange always overlaps with the second separated edge.

9. A headlamp according to claim 6, wherein the shading flange projects from the second separated edge.

10. A headlamp according to claim 9, wherein the shading flange always overlaps with the first separated edge.

11. A headlamp according to claim 6, wherein a pair of shading flanges project from the first separated edge and the second separated edge.

12. A headlamp according to claim 6, wherein the first separated edge and the second separated edge are positioned above an optical axis of the light source.

13. A headlamp according to claim 6, wherein the light source includes a discharge lamp.

14. A headlamp for a vehicle comprising:

a light source bulb;

a reflector for reflecting light rays from the light source bulb to set up a brightness intensity distribution pattern, the reflector being separated in a plurality of reflector parts;

a driving means for moving at least one movable reflector part of reflector parts to change a brightness intensity distribution pattern of light rays from the light source bulb; and a shading flange projecting from at least one of separated edges of a movable reflector part and another reflector part, the shading flange being wider than a movement range of the movable reflector, the shading flange and a separated edge always overlap with each other.

15. A headlamp for a vehicle comprising:

a light source;

a reflector for reflecting light emitted from the light source to set up a brightness intensity distribution pattern, the reflector being separated into a plurality of reflector parts:

an actuator for moving at least one movable reflector part of reflector parts to change a brightness intensity distribution pattern of light from the light source; and a shading flange projecting from at least one of separated edges of a movable reflector part and another reflector part, the shading flange being wider than a movement range of the movable reflector, the shading flange and a separated edge always overlap with each other.

16. A headlamp for a vehicle comprising:

a light source;

a reflector for reflecting light emitted from the light source to set up a brightness intensity distribution pattern, the reflector being separated into a movable reflector part and a fixed reflector part, the movable reflector part having a first separated edge, the fixed reflector part having a second separated edge facing the first separated edge;

an actuator for moving the movable reflector part relative to the fixed reflector part to change a brightness intensity distribution pattern of light from the light source; and a shading flange for shading light to transmit through an air gap between the first separated edge and the second separated edge, wherein the shading flange projects from at least one of the first separated edge and the second separated edge.

17. A headlamp according to claim 16, wherein the shading flange projects from the first separated edge.

18. A headlamp according to claim 17, wherein the shading flange always overlaps with the second separated edge.

19. A headlamp according to claim 16, wherein the shading flange projects from the second separated edge.

20. A headlamp according to claim 19, wherein the shading flange always overlaps with the first separated edge.

* * * * *